United States Patent [19]

Aemmer

[11] Patent Number: 4,774,673

[45] Date of Patent: Sep. 27, 1988

[54] METHOD FOR MONITORING YARN QUALITY ON A TEXTILE MACHINE

[76] Inventor: Peter F. Aemmer, Baeumlisaecherstrasse 35, CH 8907 Wettswil, Switzerland

[21] Appl. No.: 732,825

[22] PCT Filed: Aug. 20, 1984

[86] PCT No.: PCT/CH84/00130

§ 371 Date: Apr. 19, 1985

§ 102(e) Date: Apr. 19, 1985

[87] PCT Pub. No.: WO85/01073

PCT Pub. Date: Mar. 14, 1985

[30] Foreign Application Priority Data

Aug. 19, 1983 [CH] Switzerland ..... 4526/83

[51] Int. Cl.[4] ..... G06F 15/46; G06G 7/66

[52] U.S. Cl. ..... 364/470; 73/160; 28/187; 364/507; 364/552; 340/677

[58] Field of Search ..... 364/469, 470, 552, 507; 73/159, 160; 28/185, 187; 57/81, 264, 265, 362; 340/677, 518, 521–523

[56] References Cited

U.S. PATENT DOCUMENTS

| | | | |
|---|---|---|---|
| 3,729,635 | 4/1973 | Shottenfeld et al. | 364/470 |
| 3,731,069 | 5/1973 | Goto et al. | 73/160 |
| 4,030,082 | 6/1977 | Goto | 364/470 |
| 4,045,659 | 8/1977 | Akagawa et al. | 364/470 |
| 4,051,722 | 10/1977 | Feller | 73/160 |
| 4,058,962 | 11/1977 | Spescha et al. | 73/160 |
| 4,430,720 | 2/1984 | Aemmer | 364/470 |
| 4,656,465 | 4/1987 | Erni et al. | 364/470 |

*Primary Examiner*—Parshotam S. Lall
*Assistant Examiner*—Brian M. Mattson
*Attorney, Agent, or Firm*—Antonelli, Terry & Wands

[57] ABSTRACT

Method for the simultaneous monitoring of yarn quality on a number of similar monitoring points of a textile machine, in which each monitoring point uses one measuring element together with the processors assigned to the measuring elements for processing the pulses supplied by the measuring elements, whereby the various data processing stages for the individual monitoring points run at different rates of repeat. Each group of several measuring elements is allocated to a common processor and the pulse procesing stages with the same rates of repeat are grouped into classes and the rate of running these classes is so controlled that with respect to the individual monitoring points, the relevant data processing stages are repeated approximately periodically. Local processors for processing the classes of grouped data processing stages are used for fault analyses and fault action in the steady running mode, and a central processor is provided for fault analyses and fault action in the start-up mode and at the start of steady running mode, to which central processor any monitoring point in the start-up is switched and on reaching the steady running mode is again switched off.

8 Claims, 4 Drawing Sheets

METHOD FOR MONITORING YARN QUALITY ON A TEXTILE MACHINE

SUMMARY

Figure 1A:
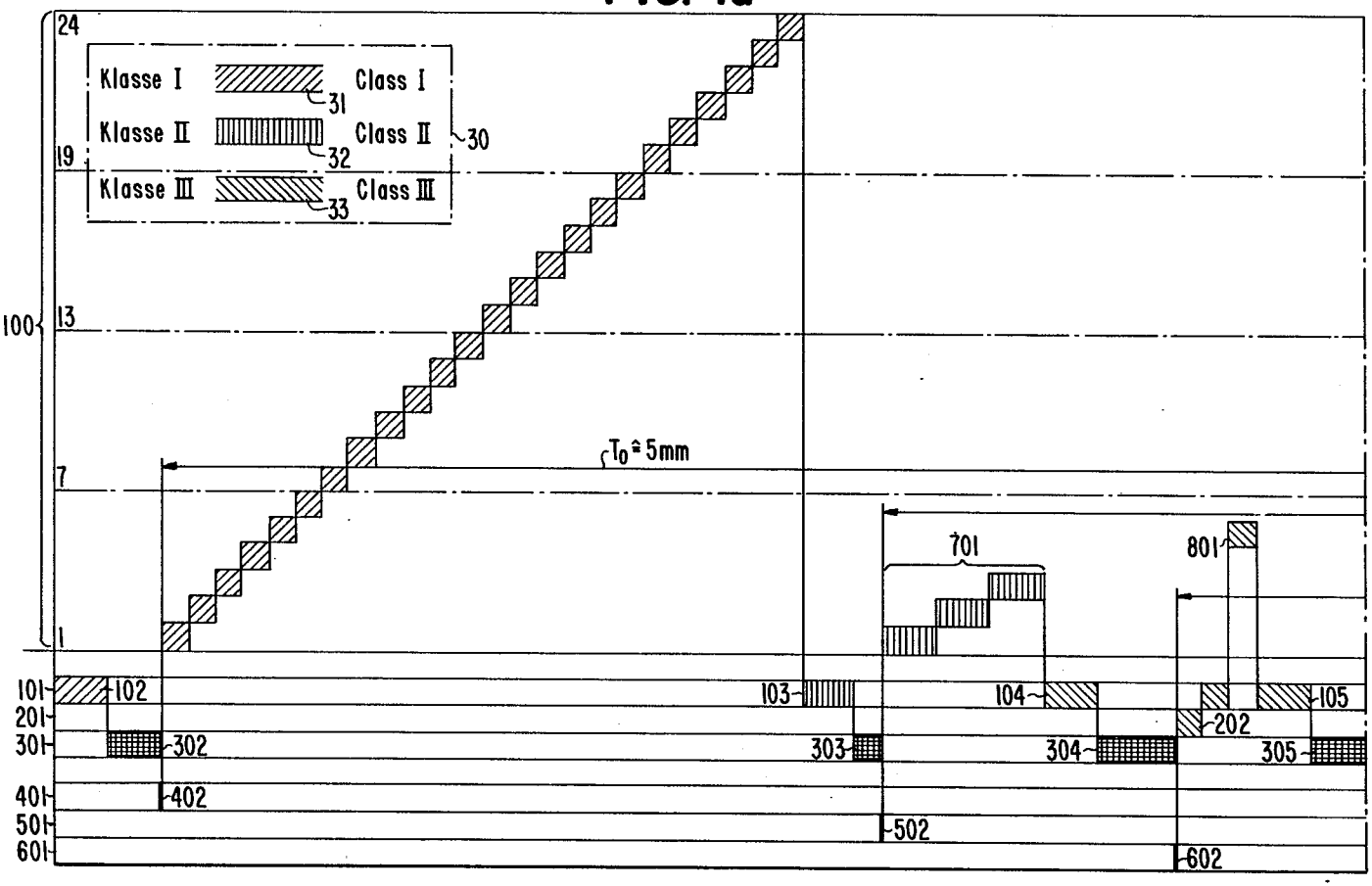

In a method for monitoring yarn quality on a textile machine, the yarn pulses (55) obtained at the monitoring points in groups of for example every 24 monitoring points are first analysed for suspected faults cyclically in processes of a first category. The products of this analysis are from time to time transmitted together in batches to processes of a second category, in which decisions are made on action to be taken and warnings to be triggered, whereupon the products are in turn from time to time transmitted together in batches to processes of the first category and there the performance of the necessary action is triggered.

For fault analysis and processing in the start-up mode and in the initial stages of the steady mode of operation, a common special system is provided for the whole or a part of the textile machine, which is designed for the particular characteristics of this start-up mode of operation, with which the yarn pulses in the start-up mode are analysed.

Analyses for fault characteristics are performed periodically at a frequency corresponding approximately to the inverse ratio between the reference lengths of the corresponding fault characteristics, whereby the sensing rate is artificially reduced (decimated) and the signal analysis performed with the mean values obtained by decimation.

The layout is such that in satellites (53) connected to a central processor (51) via a communication channel (80) there is the system for fault analysis in the steady mode of operation, and in the central processor (51) there is the collective system for fault analysis in the start-up mode of operation.

The requirements of yarn clearer and yarn quality monitoring installations for unconventional spinning methods such as rotor spinning etc. differ from the requirements of conventional yarn clearer installations for ring-spun yarns on winding machines in the following points:

(a) Types of faults: In addition to well known yarn faults (short thick places, coarse yarns and thin places), periodic and aperiodic fault sequences, deviations from count and variations in yarn evenness can occur.

(b) Frequency of faults: These are per unit length, smaller by approximately a power of one, and per unit time, less frequent by approximately a power of two. (Yarn speed in unconventional spinning methods is about 10 times lower than in rewinding).

(c) Yarn lot size: One machine, typically comprising 200 and more spinning points, is always producing the same yarn quality on all spinning points, i.e. the spinning parameter values are set identically for all spinning points.

(d) Yarn joining, splicing: One machine, typically with 200 and more spinning points is patrolled by a single travelling joining machine, i.e. there is never more than one single joining process taking place at the same time.

(e) Function value of the monitoring length: Related to the spinning point, this is much smaller as a yarn length smaller by about a factor of one can be monitored per unit time and additionally the objectionable yarn faults are less frequency and consequently the potential resultant costs are on average smaller (see b).

It follows from the above that with a smaller function value and consequently with lower admissible sales prices and manufacturing costs, a solution must be found which satisfies high technical requirements with respect to detection of types of faults. The solution sought is less critical with respect to frequency per unit time of anticipated fault occurrence and on simultaneous occurrence of possible start-up acceleration processes (only one at a time).

Known attempts at a solution are based on the conventional structural composition of yarn clearer installations, where there is one measuring head provided for each machine position and each head has its own evaluation unit. The latter receives from a central control and supply unit the required operating power and control pulses for the relevant values of the set parameters and transmits to the unit (if equipped for the purpose) basic data or pulses for machine-related and possibly superior production data processing systems.

The individual evaluation unit performs all functions in relation to clearing and quality monitoring associated with the machine position to which it is allocated.

The question of cost is taken into consideration by only the most significant or most easily detectable of the types of faults monitored being taken into account.

The present invention relates to a method and device for the simultaneous monitoring of yarn quality on a textile machine at a number of similar monitoring points and has the features defined in the claims.

The solution in accordance with the invention is based on the integration of several monitoring points into one group and the performance of certain or all functions by the same function carrier or processor cyclically, and furthermore by the performance at a central point of functions which can affect all monitoring points but which are to be observed simultaneously at no more than one point.

The advantage of this attempt at a solution lies in the use of microprocessors and the use of known methods of digital processing for the analysis of the yarn pulses.

Thus for example for the detection of short thick places as well as periodic or aperiodic series of faults, it is necessary to run alogorithms suitable for the purpose every 5 mm length of yarn running through, using indices which are proportional to the mean cross-section or diameter of about 5 mm yarn.

On the other hand, for the detection of coarse yarns or long thin places it is sufficient to apply suitable alogorithms every 10 to 20 cm using mean indices of yarn cross-section or diameter over the last 10 to 20 cm respectively.

The detection of variations in yarn count is even only meaningful when mean values over lengths of several meters are used in the analysis.

On each monitoring point, the alogarithms or processes indicated must be run in a time-critical way at a fixed cycle, some with a high rate of repeat, others with a rate slower by a power factor of one or more.

For the purpose of uniform utilisation of the available capacity of a processor allocated to a group, it is advisable to group processes with equal rates of repeat into classes, and to arrange these classes in relation to each other over the course of time in such a way that, related to the individual monitoring point, each process applied to it is repeated at least approximately periodically.

The arrangement of the timing of the individual classes is to be understood as follows: in the course of time for example processes with the highest rate of repeat (Class I) run cyclically for all monitoring points, processes with an intermediate rate of repeat (Class II) run intermittently but only for a proportion of the monitoring points, and processes with a slow rate of repeat (Class III) run for only one or a few monitoring points.

Figure 1B:
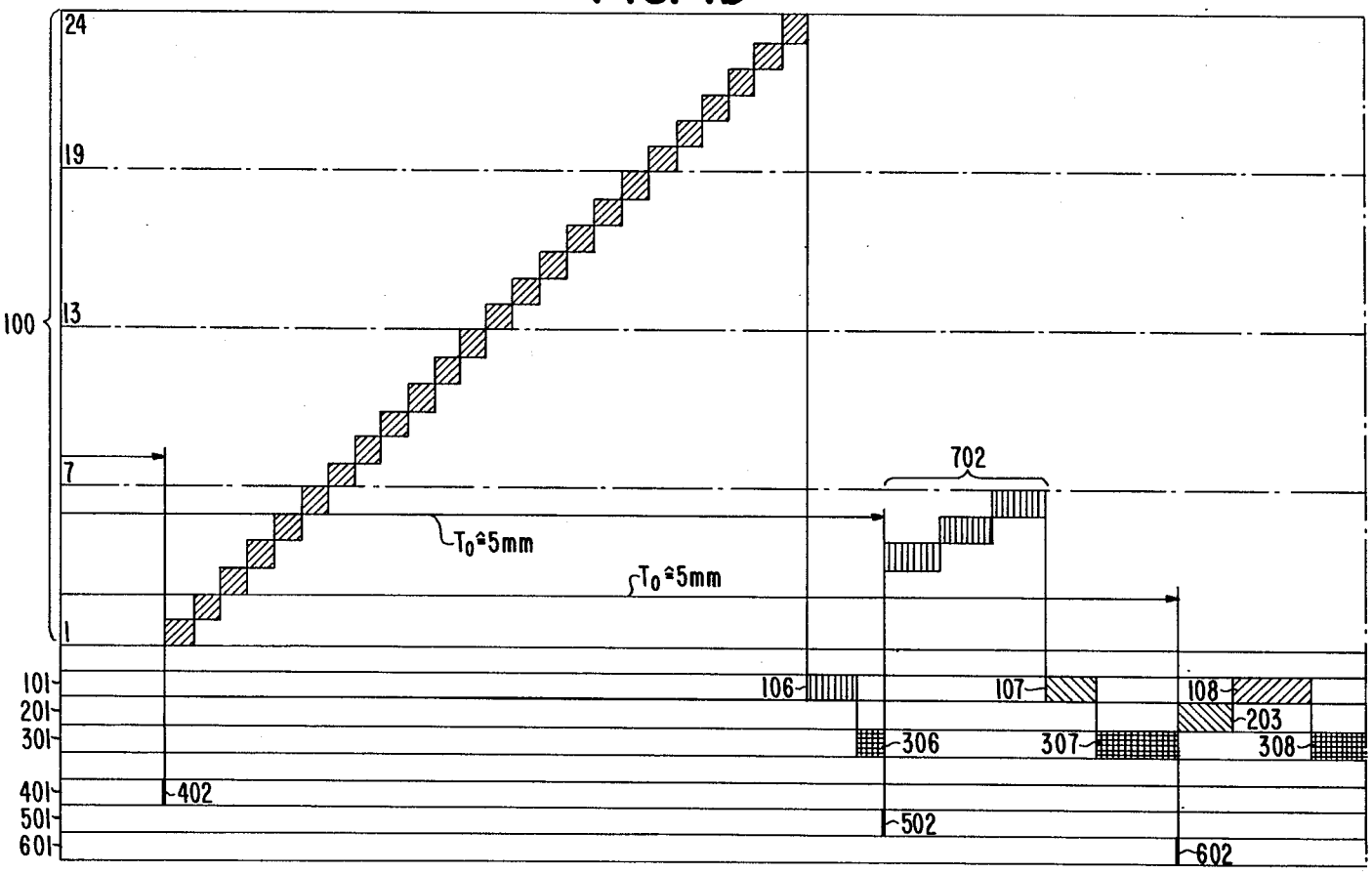
Figure 1C:
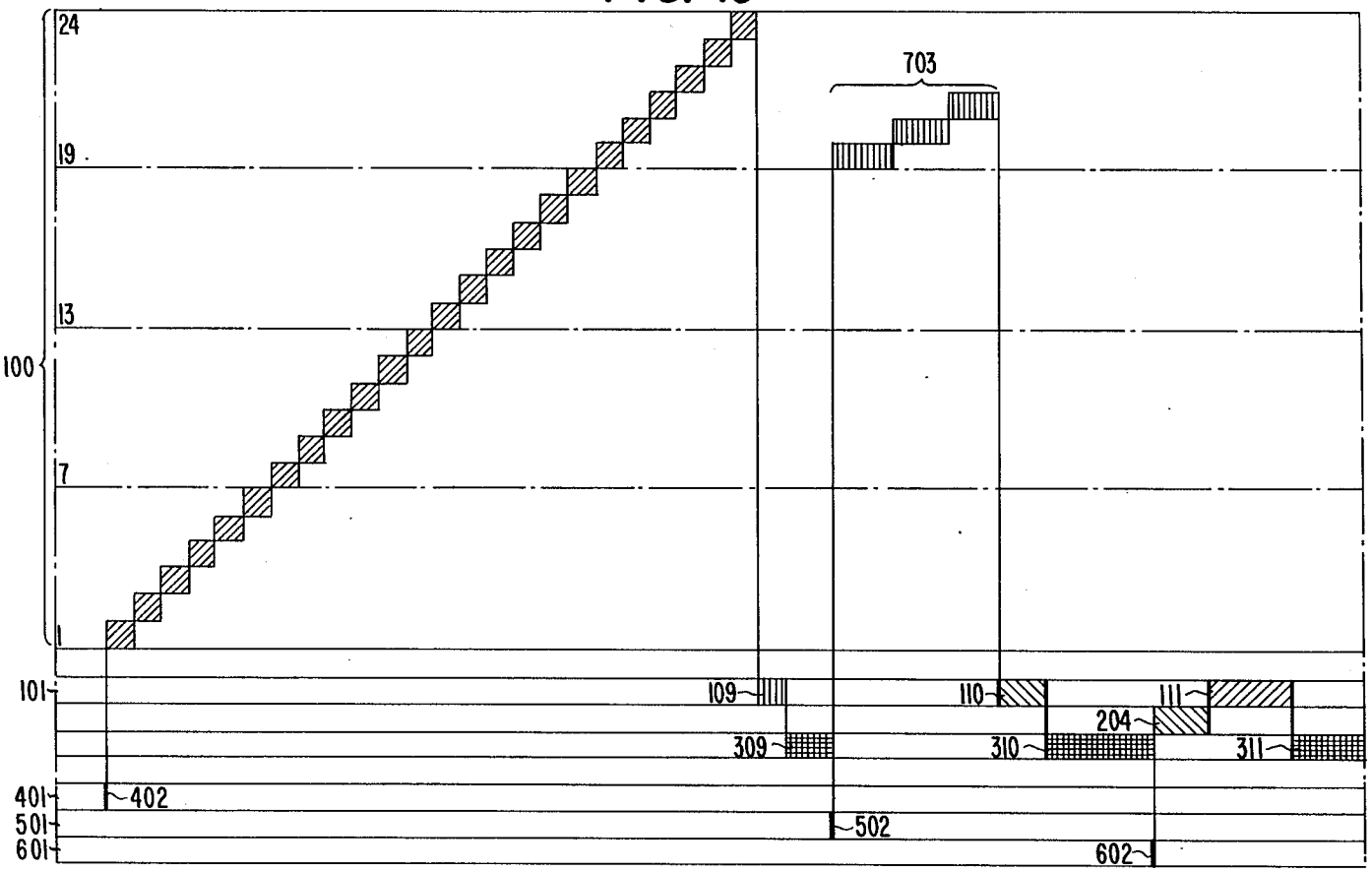

The method in accordance with the invention will be described in greater detail with the aid of the diagrams. FIGS. 1*a*, 1*b* and 1*c* show in diagram form a section from the progress in time of the most important processes of the first category. FIGS. 1*a*, 1*b* and 1*c* are to be considered with their narrow sides set side by side.

Figure 2:
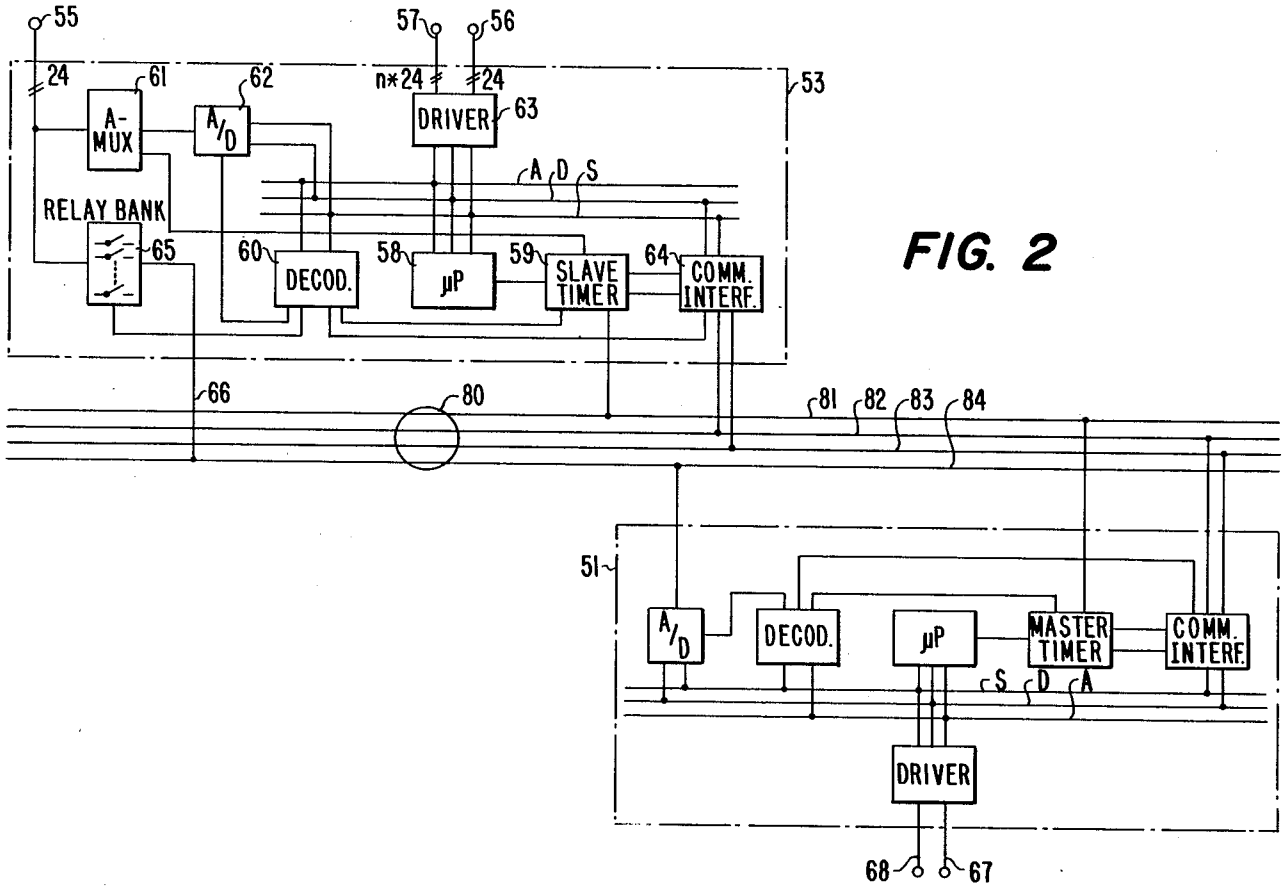

FIG. 2 shows the block diagram of a possible form of the system in accordance with the invention.

The time progress diagram of FIGS. 1*a*–1*c* relates to the most important processes which run for example in a satellite in accordance with claim 8. It is assumed here that this satellite serves a group of 24 monitoring points.

In the upper zone 100 of the time progress diagram the processes are represented which carry out the analysis of the pulses transmitted by the measuring heads which are allocated to monitoring points 1–24. In the lower part, in a first line 101 there is the time allocation of processes for auxiliary and additional functions 102, 103, 104, . . . , in a second line 201 the time allocation of processes for the preparation and processing of information in conjunction with the reciprocal exchange of product between the processes of the first and second categories, in a third line 301 the delay intervals 302, 303, . . . on corresponding synchronisation signals 402, 502, 602, and in lines 401, 501 and 601 there are these actual synchronisation signals.

Inset 30 in FIG. 1*a* explains the shading identifying the processes of Class I 31, of Class II 32 and of Class III 33 on the time progress diagrams of FIGS. 1*a*–1*c*. It is also assumed that synchronisation signal 402 initiates the time-critical processes of Class 1, synchronisation signal 502 the time-critical processes of Class II, and synchronisation signal 602 the time-critical processes of Class III.

It is furthermore assumed that synchronisation signals 402, 502 and 602 occur periodically, namely each with a periodicity $T_0$ corresponding to a yarn length of 5 mm.

Using the example of FIG. 1*a*–1*c*, a more detailed explanation will now be given of the possible time progress within the scope of the invention of processes divided into 3 classes for 24 monitoring points. It is assumed that the corresponding processes run on a common processor (as shown for example in accordance with block diagram of FIG. 2).

In the example of FIG. 1*a*–1*c* the processes of Class I 31 include in their functions the analysis of short yarn faults, which require a sensing rate for example of 5 mm yarn passing through, consequently of short thick places and of periodic and aperiodic series of faults.

Processes of Class II 32 run for example at a rate of repeat 8 times slower (related to the individual monitoring points). Included in these processes are analyses for coarse yarns and long thin places. Related to the passage of yarn they thus run at a rate of repeat of 4 cm. This reduced rate of repeat is achieved (whilst maintaining the periodicity per monitoring point) by monitoring points 1. . . 3; 4. . . 6; 7. . . 9; . . . 22. . . 24 coming into action alternately.

Finally processes of Class III 33 run for example at a rate of repeat 8 times slower still, related to the passage of yarn thus every 32 cm. The functions involved are analyses for variation of yarn count together with the sending and receiving of data batches on line with the central processor and possibly other groups.

The sending and receiving of data batches with processes of Class III is explained by the fact that in the rhythm of the rate of repeat of Class I a batch of data is exchanged each time (sent or received). In accordance with the example explained, this can be a batch of fixed format from a structured supply of 64 such batches which are exchanged cyclically one after the other. Thus one batch, which contains information of the same type (machine setting parameters or stop commands for certain monitoring points) accordingly comes for transmission only every 64th time, i.e. every 32 cm of yarn travel. Without departing from the sense of the invention this principle may be varied within wide limits and adapted to actual requirements.

Various auxiliary functions 102, 103, 104, . . . are needed for performing the extensive multiplex system: for switching to the individual monitoring points, for data reduction (calculation of the mean, commonly called: decimation), for initialisation and for performing and analysing the data interchange, etc. Assuming that these additional functions are to be performed by the group processor, they must most usefully be allocated also to one of the 3 classes.

For example, the reduction of the data rate by a factor of 8 and the associated decimation is an auxiliary function which must be performed for the yarn pulse of each monitoring point separately. A corresponding decimation alogorithm is thus allowed to run before or after the relevant alogorithm for analysis of signals of Class I as preparation for the analysis of signals of Class II. Data reduction and preparation of the signal analysis of Class III proceeds in a similar way.

Auxiliary and additional functions not allocated to the individual monitoring points may include the management of address indices, of memory space for the intermediate storage of intermediate results together with the servicing and receiving of synchronisation signals.

The block diagram in accordance with FIG. 2 shows a central processor 51 and a satellite 53 connected to it by a communication channel 80. For understanding the system it is explained that generally several satellites are linked to the communication channel and each satellite serves a number of similar machine points.

In the example of FIG. 2, the satellite 53 is fed by 24 (analogous) yarn pulses 55, emitted by yarn sensors (measuring heads) of known technique fitted on the textile machine. At the machine end it has 24 terminals 56 for cut-out purposes and n times 24 terminals 57 for warning signals.

One terminal 56 is provided for each machine point for cut-out purposes. It interrupts for supply of fibre or triggers the cutter of a clearer.

At each machine point n terminals 57 are provided for warning signals. Their purpose is to display the type of fault discovered on the corresponding point, the state of the point etc.

The satellite 53 is constructed in microprocessor technology of known type. The microprocessor 58, as the heart of the satellite is connected to an address circuit, to a data circuit and to a control circuit (A, D, S) and receives its timing from an external timing device 59. The function of a decoder 60 is to decode addresses of individual modules. The yarn pulses are transmitted through an analog multiplexer 61 controlled by the timer to an A/D transducer 62, from where they are called up by the microprocessor 58.

The cut-out and warning terminals 56, 57 are taken out through a driver 63.

A special communication processor 64 accomplishes the batchwise transfer of data between communication channel 80 and microprocessor 58. Communication with the central processor 51 takes place serially on a separate circuit each for sending and receiving. Communication with the microprocessor takes place in parallel via sending and receiving storage devices which are fed or read by the microprocessor. Sending and receiving are controlled by the timer 59.

The switching of the monitoring point of a machine position in the state of start-up is carried out by a relay bank 65 controlled by the microprocessor. The yarn pulse 66 is transmitted as an analog signal to the central processor 51.

The central processor 51 as shown in the example of FIG. 2 gives pulses for warning 67 and commands for intervention 68 to the central control unit of the machine. Connections to input terminals, data collection systems etc. are not shown as they are not relevant to the subject of the invention. Connections of this kind are in keeping with current technology and are easily possible.

The circuitry of the central processor 51 is designed in known microprocessor technology. Any special explanation is unnecessary.

The communication channel as shown in the example of FIG. 2 is designed as a busbar system. The transmission of information exchanged between satellite 53 and central processor 51 is performed digitally serially on two directionally separated circuits 82, 83. A special timing circuit 81 is used for synchronisation. The transmission of the analog yarn pulse 66 of the monitoring point belonging to the machine position in a state of start-up takes place in the form of analog voltage via a common circuit 84.

The advantages of the invention may be described as follows:

The physical separation of the functions 'fault analysis and processing in the steady mode of operation' and 'fault analysis and processing in the start-up mode of operation' has the effect of significantly reducing expenditure by the implementation of microprocessor technology in circuitry compared with conventional methods.

Reason: Sensing of the yarn pulses must proceed at a fixed rate (every 5. . . 10 mm of yarn travel). Analysis of faults in the running mode takes place in accordance with comparatively simple criteria. Fault analysis in the start-up state is, on the other hand, more complicated and more costly (investigation for double ends, coarse yarns and thin places). On the textile machines in question, as only one machine position can be in the start-up mode at any one time (patrolling joining device, patrolling knotter, etc.) a single transferrable device is sufficient for monitoring the state of start-up.

The division of the functions "fault analysis and processing in the steady mode of operation" into "processes running in synchronisation with yarn travel" of the first category (analysis for the presence of fault) and into 'processes not necessarily running in synchronisation' of the second category (making decisions on action to be taken and warnings to be triggered) brings a further significant reduction in expenditure compared with conventional methods by the implementation of microprocessor technology in the circuitry.

Reason: Sensing of the yarn pulses must proceed at a fixed rate (every 5. . . 10 mm of yarn travel). Analysis for suspicion of fault takes place in accordance with very simple criteria and the result is mostly negative. The criteria for triggering a warning and/or cutting out a machine position require additional features which are only to be considered in the case of positive suspicion of fault (thread travel, jamming). The triggering of cut-outs and warnings is also time-critical. Delays of 10 to 20 cm and more (related to yarn travel) are, however, quite tolerable, as when operation is cut-out and subsequently restarted at least about 1 meter of yarn is always removed. As yarn faults are very infrequent phenomena on the textile machines in question, it is wise to process the "suspected faults" together in one device (central processor) responsible for several satellites and many monitoring points.

Nowadays inexpensive single-chip microprocessors are commercially available which are eminently suitable for implementation. In the textile machines in question, present yarn speeds of travel are at about 150 m/min maximum. This enables 12 to 24 monitoring points to be serviced by a single processor if operations are restricted to the analysis of the most commonly time-critical criteria (suspected fault). This number of machine positions is also apt from a textile technology aspect and corresponds to a conventional "section".

The additional expenditure incurred by exchanging the batches of data between the two categories of processes is minimal as nowadays inexpensive single-chip microprocessors are commercially available in which the required communication processors for bit-serial transmission on hardware are integrated on the same chip. The data rates specified are so high that a bus system is possible without difficulty.

The "shuffling" arrangement of the timing stipulated in claims 3 to 6 for suspected fault analysis for long coarse yarns and thin places permits efficient handling of these types of faults. Based on the scanning theorem (Nyquist), with digital signal processing, a sensing and processing rate of the order of 5. . . 10 cm yarn only is necessary. By servicing alternately only a proportion of all monitoring points 'intermittently', the load on the signal processor used is balanced over the course of time without sacrificing the periodicity of processing.

The practical consequence is that with a given processor and given yarn speed of travel it is possible to service a greater number of monitoring points simultaneously than without this device.

I claim:

1. A method for simultaneous monitoring of yarn quality of yarn at a number of monitoring positions of a textile machine, wherein a measuring element is provided at each monitoring position to provide signals indicative of a property of the yarn at each monitoring position, so that yarn quality may be determined by processing of said signals using different signal processing operations to detect different types of yarn faults, comprising:

(a) transmitting signals from the measuring elements to a processing facility having a plurality of processors; and (b) performing in said processors different signal processing operations having different repetition frequencies on signals received from said measuring elements in such a way that said signal processing operations are grouped into classes according to their repetition frequency and the respective classes of signal processing operations are performed in a predetermined sequence so that with respect to individual monitoring positions the signal processing operations are repeated periodically.

2. A method according to claim 1, wherein said processing facility includes a plurality of local processors and a central processor, and wherein said step (b) comprises, operating said central processor to perform said different signal processing operations for fault analysis and fault treatment in a start-up mode of operation, and subsequently switching to operation of said local processors to perform at least some of said different signal processing operations for fault analysis and fault treatment in a steady running mode of operation.

3. A method according to claim 2, wherein classes of signal processing operations within a predetermined high range of repetition frequency are performed cyclically within said sequence for all monitoring points and classes of signal processing operations within a predetermined low range of repetition frequency are performed for less than all of said monitoring points.

4. A method according to claim 3, wherein signal processing operations for detecting characteristics of short and long faults are performed at a repetition frequency corresponding to an inverse ratio of reference lengths of respective characteristics.

5. A method according to claim 4, wherein signal processing operations for detecting characteristics of long faults are performed at a sensing rate artifically reduced in relation to yarn length on the basis of corresponding mean values, and in which a reduction factor of a sensing rate corresponds approximately to reference lengths of long and short faults.

6. A method according to claim 4, wherein the signals from all monitoring points are analyzed in said processing facility during each of a plurality of sensing cycles to detect characteristics of short faults, and only signals from a portion of the monitoring points are analyzed at a reduced sensing rate individually and relative to each other in cyclic sequence for detection of characteristics of long faults.

7. A method according to claim 6, wherein signals from a portion of the monitoring points are analyzed for detection of extremely long faults at a sensing rate which is further reduced from the sensing rate for long faults.

8. A method according to claim 2, wherein the signal processing operations performed in said processing facility for fault action and fault analysis in the steady running mode are divided into a first category which relate to operations which occur synchronously with yarn travel and a second category which relate to operations which do not necessarily occur synchronously, the signal processing operations in said second category being performed during the steady running mode by said central processor.

* * * * *